US007597727B1

(12) United States Patent
Morris

(10) Patent No.: US 7,597,727 B1
(45) Date of Patent: Oct. 6, 2009

(54) METHOD OF STARTING A FIRE

(76) Inventor: Allan P. Morris, P.O. Box 880, Colfax, CA (US) 95713

( * ) Notice: Subject to any disclaimer, the term of this patent is extended or adjusted under 35 U.S.C. 154(b) by 928 days.

(21) Appl. No.: 11/105,205

(22) Filed: Apr. 14, 2005

(51) Int. Cl.
*C10L 11/00* (2006.01)

(52) U.S. Cl. ..... 44/531

(58) Field of Classification Search ..... 44/531
See application file for complete search history.

(56) References Cited

U.S. PATENT DOCUMENTS 1,084,369 A * 1/1914 Smith ..... 44/531
D186,320 S 10/1959 Mustin
3,613,658 A * 10/1971 Knowles et al. ..... 44/275
3,988,121 A 10/1976 Leveskis
4,189,305 A 2/1980 Clayton
4,725,286 A 2/1988 Brame
5,711,766 A 1/1998 Bain
6,027,539 A 2/2000 Toy

* cited by examiner

*Primary Examiner*—Cephia D Toomer

(57) ABSTRACT

A fire starting method includes a container that that has a plurality of compartments. Each of the compartments includes a bottom wall and a peripheral wall. Each of the peripheral walls has an upper edge that defines an opening into a respective one of the compartments. The compartments are joined together along their upper edges and define attached edges. The upper edges are coplanar with respect to each other. The compartments are aligned in a plurality of rows and columns. The container is comprised of a flammable material. A fire ignition material is positioned in each of the containers. Kindling is placed in a woodpile and one of the compartments is removed from the container. The first ignition material is removed from the compartment, the compartment lit on fire and positioned in the kindling. The fire ignition material is then placed on the ignited compartment.

7 Claims, 1 Drawing Sheet

METHOD OF STARTING A FIRE

BACKGROUND OF THE INVENTION

1. Field of the Invention

The present invention relates to fire starting methods and more particularly pertains to a new fire starting method for aiding a person in igniting a woodpile.

2. Description of the Prior Art

The use of fire starting methods and devices are known in the prior art. U.S. Pat. No. 5,711,766 describes a brick device which may be placed in a pile of wood and lit on fire so that the entire woodpile is ignited. Another type of fire starting device is U.S. Pat. No. 3,988,121 describes a plug comprised of combustible wax which may be positioned adjacent to wood and ignited so that wood also catches fire. Yet another such device is found in U.S. Pat. No. 4,189,305 which again includes a combustible wax mixture.

While these devices fulfill their respective, particular objectives and requirements, the need remains for a method and device which contains a plurality of discrete packets which may be removed and added to kindling, such as small sticks, to increase the flammability of the kindling. This will aid a person in ensuring that that wood, positioned around the kindling, will ignite.

SUMMARY OF THE INVENTION

The present invention meets the needs presented above by comprising providing a container that includes a plurality of compartments. Each of the compartments includes a bottom wall and a peripheral wall extending upwardly from the bottom walls. Each of the peripheral walls has an upper edge that defines an opening into a respective one of the compartments. The compartments are joined together along their upper edges and define attached edges. The upper edges are coplanar with respect to each other. The compartments are aligned in a plurality of rows and columns. The container is comprised of a flammable material. A fire ignition material is positioned in each of the containers. Kindling is placed in a woodpile and one of the compartments is removed from the container. The first ignition material is removed from the compartment, the compartment lit on fire and positioned in the kindling. The fire ignition material is then placed on the ignited compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
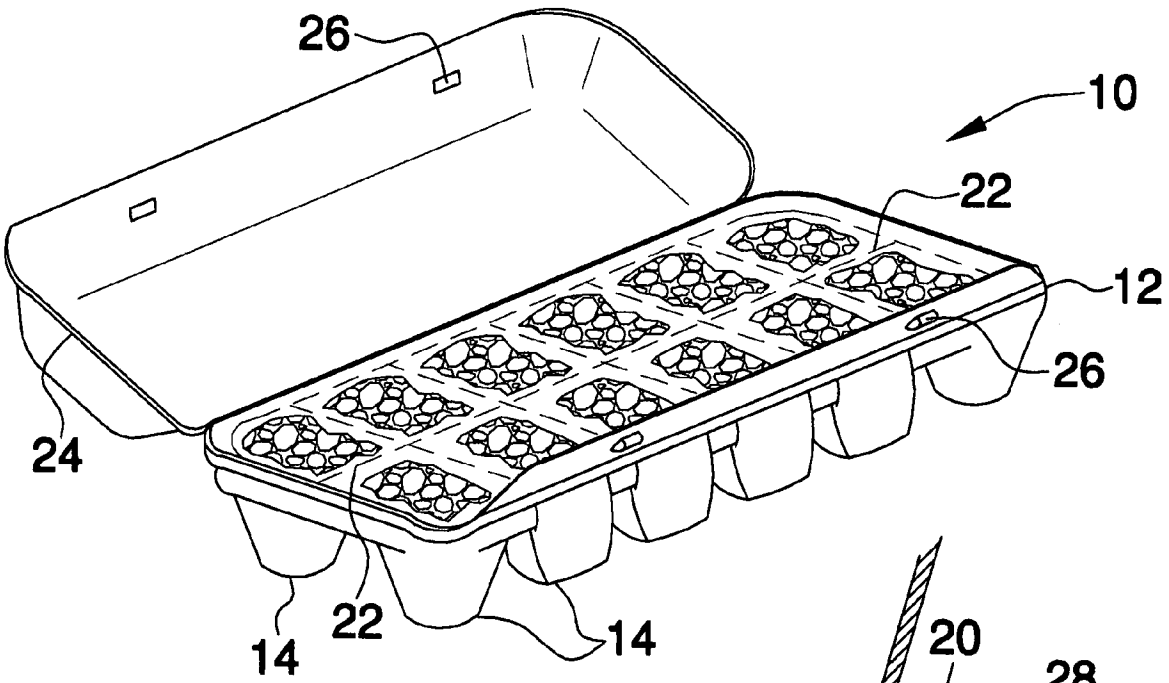
FIG. 1 is a perspective view of a method of starting a fire according to the present invention.
Figure 2:
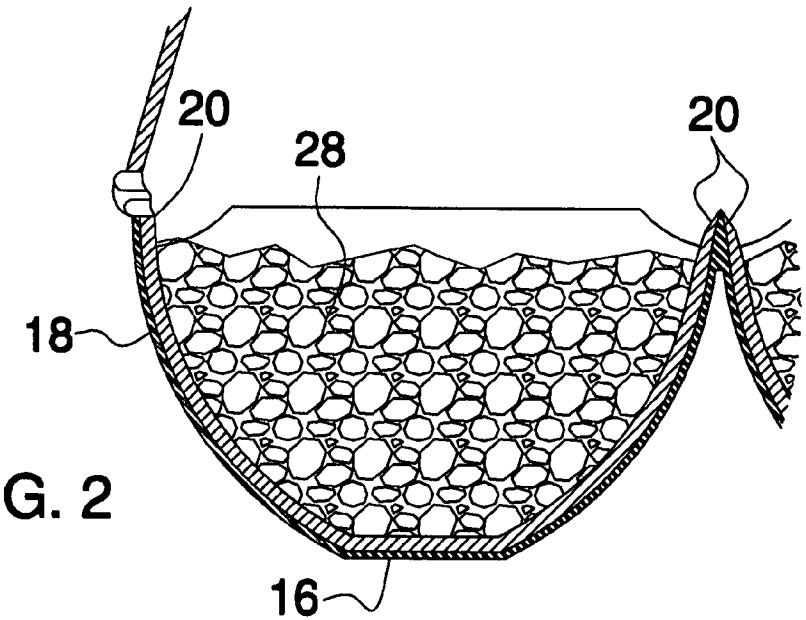
FIG. 2 is a cross-sectional view of the present invention.

With reference now to the drawings, and in particular to FIGS. 1 through 2 thereof, a new fire starting method embodying the principles and concepts of the present invention and generally designated by the reference numeral 10 will be described.

As best illustrated in FIGS. 1 through 2, the method of starting a fire 10 generally comprises providing a container 12 that includes a plurality of compartments 14. Each of the compartments 14 includes a bottom wall 16 and a peripheral wall 18 extending upwardly from the bottom walls 16. Each of the peripheral walls 18 has an upper edge 20 defining an opening into a respective one of the compartments 14. The compartments 14 are joined together along their upper edges 20 so that attached edges 22 are defined. The upper edges 20 are coplanar with respect to each other. The compartments 14 are aligned in a plurality of rows and columns. The attached edges 22 are perforated so that the compartments 14 may be selectively removed from each other along the attached edges 22. Each of the compartments 14 has a volume generally between 1 cubic inch and 3 cubic inches. The container 12 is comprised of a flammable material such as cardboard which may be coated with a wax layer to make it generally waterproof and to give it an even burn. As is shown in FIG. 1, an egg carton type design may suffice as long as the attached edges 22 are perforated.

A cover 24 is pivotally coupled to the container 12 and is selectively positionable in a closed position covering the compartments 22 or in an open position. A locking assembly is positioned on the cover 24 for selectively locking the cover 24 in the closed position. The locking assembly preferably includes interlocking tabs 26.

A fire ignition material 28 is positioned in each of the containers 22. The fire ignition material 28 preferably comprises wood shavings of a size to make them highly flammable.

In use, a woodpile is formed and conventional kindling, such as small sticks and twigs, is placed in a central located of the woodpile. One of the compartments 14 is removed from the container 12 along the perforations and the fire ignition material 28 removed from the compartment 14 that was removed from the container 12. The removed compartment 14 is then lighted on fire and placed in the kindling. The fire ignition material 28 is then placed on the compartment so 14 that the fire ignition material is ignited by the compartment 14. The fire ignition material 28, once ignited, ensures that the kindling starts on fire and thereafter the pile of wood is started on fire.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of starting a fire comprising the steps of:

providing a container including a plurality of compartments, each of said compartments including a bottom wall and a peripheral wall extending upwardly from said bottom walls, each of said peripheral walls having an upper edge defining an opening into a respective one of said compartments, each of said compartments being joined together only along their upper edges and defining attached edges, said upper edges being coplanar with respect to each other, said compartments being aligned in a plurality of rows and columns, said container being comprised of a flammable material;

providing a fire ignition material being positioned in each of said containers;

forming a woodpile and placing kindling in a central location of said woodpile;

removing one of said compartments from said container;

removing said fire ignition material from the compartment removed from the container and lighting the compartment on fire;

placing the compartment lit on fire in the kindling; and placing the fire ignition material on the compartment so that the fire ignition material is ignited by the compartment.

2. The method according to claim 1, wherein said compartments are aligned in a plurality of rows and columns.

3. The method according to claim 1, wherein said attached edges are perforated.

4. The method according to claim 3, wherein each of said compartments has a volume generally between 1 cubic inch and 3 cubic inches.

5. The method according to claim 1, further providing a cover being pivotally coupled to said container and being selectively positionable in a closed position covering said compartments or in an open position, a locking assembly being positioned on said cover for selectively locking said cover in said closed position.

6. The method according to claim 3, wherein said fire ignition material comprising wood shavings.

7. A method of starting a fire comprising the steps of:

providing a container including a plurality of compartments, each of said compartments including a bottom wall and a peripheral wall extending upwardly from said bottom walls, each of said peripheral walls having an upper edge defining an opening into a respective one of said compartments, each of said compartments being joined together along their upper edges and defining attached edges such that the upper edges are each coplanar with respect to each other, said compartments being aligned in a plurality of rows and columns, said attached edges being perforated, each of said compartments having a volume generally between 1 cubic inch and 3 inch cubic inches, said container being comprised of a flammable material;

providing a cover being pivotally coupled to said container and being selectively positionable in a closed position covering said compartments or in an open position, a locking assembly being positioned on said cover for selectively locking said cover in said closed position;

providing a fire ignition material being positioned in each of said containers, said fire ignition material comprising wood shavings;

forming a woodpile and placing kindling in a central location of said woodpile;

removing one of said compartments from said container;

removing said fire ignition material from the compartment removed from the container and lighting the compartment on fire;

placing the compartment lit on fire in the kindling; and placing the fire ignition material on the compartment so that the fire ignition material is ignited by the compartment.

* * * * *